US006221552B1

(12) United States Patent
Street et al.

(10) Patent No.: US 6,221,552 B1
(45) Date of Patent: Apr. 24, 2001

(54) PERMANENT PHOTORECEPTOR MARKING SYSTEM

(75) Inventors: Terry L Street, Fairport; Edward F Grabowski, Webster, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/487,573

(22) Filed: Jan. 19, 2000

(51) Int. Cl.[7] ..... G03G 5/00

(52) U.S. Cl. ..... 430/130; 430/136; 283/93; 283/100; 428/916

(58) Field of Search ..... 430/130, 136; 283/93, 100; 428/916

(56) References Cited

U.S. PATENT DOCUMENTS

| | | | |
|---|---|---|---|
| 4,049,945 | 9/1977 | Ehlscheid et al. | 219/121.67 |
| 4,549,063 | 10/1985 | Ang et al. | 219/121.69 |
| 4,588,666 | 5/1986 | Stolka et al. | 430/96 |
| 4,639,572 | 1/1987 | Gruzman et al. | 430/84 |
| 4,855,203 | 8/1989 | Badesha et al. | 430/54 |
| 4,871,634 | 10/1989 | Limburg et al. | 430/292 |
| 5,091,284 | 2/1992 | Bradfield | 219/121.69 |
| 5,208,604 | 5/1993 | Watanabe et al. | 347/47 |
| 5,312,517 | 5/1994 | Ouki | 219/121.69 |
| 5,320,789 | 6/1994 | Nishii et al. | 264/446 |
| 5,415,939 | 5/1995 | Yeung | 428/422 |
| 5,421,619 * | 6/1995 | Dyball | 283/93 |
| 5,442,384 | 8/1995 | Schantz et al. | 347/20 |
| 5,521,047 | 5/1996 | Yuh et al. | 430/134 |
| 5,576,130 | 11/1996 | Yu et al. | 430/60 |
| 5,614,341 | 3/1997 | Mishra et al. | 430/60 |
| 5,630,308 | 5/1997 | Guckenberger | 53/412 |
| 5,643,706 | 7/1997 | Brillson et al. | 430/127 |
| 5,688,355 | 11/1997 | Yu | 156/272.8 |
| 5,703,487 | 12/1997 | Mishra | 324/456 |
| 5,709,974 | 1/1998 | Yuh et al. | 430/66 |
| 5,874,193 | 2/1999 | Liu et al. | 430/64 |
| 5,891,594 | 4/1999 | Yuh et al. | 430/71 |
| 5,975,583 * | 11/1999 | Cobben et al. | 283/93 |

FOREIGN PATENT DOCUMENTS

| | | | |
|---|---|---|---|
| 1081619 * | 3/1984 | (RU) | 430/130 |

OTHER PUBLICATIONS

Texturing of Organic Photoreceptor Surfaces by Laser Ablating to Assist Blade Cleaning, Xerox Disclosure Journal, vol. 16, No. 2 Mar./Apr. 1991.*

* cited by examiner

*Primary Examiner*—Mark Chapman
(74) *Attorney, Agent, or Firm*—Oliff & Berridge, PLC; Eugene O. Palazzo

(57) ABSTRACT

A method for permanently marking a photoreceptor surface includes the steps of irradiating a surface of a photoreceptor with an irradiation source to permanently mark the photoreceptor, and ablating material from the photoreceptor to at least one controlled depth in the photoreceptor with the irradiation source.

18 Claims, No Drawings

PERMANENT PHOTORECEPTOR MARKING SYSTEM

BACKGROUND OF THE INVENTION

1. Field of Invention

The present invention relates in general to electrophotography and, in particular, to a process for permanently marking electrophotographic imaging members or photoreceptors with fiducial or registration marks, as well as photoreceptors produced thereby. The present invention provides a process for forning fiducial or registration marks on a photoreceptor such that the marks may or may not readily appear, at least to the naked eye, on a print made from such a photoreceptor.

2. Description of Related Art

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. Current layered organic imaging members generally have at least a substrate layer and two active layers. These active layers generally include (1) a charge generating layer containing a light-absorbing material, and (2) a charge transport layer containing electron donor molecules. These layers can be in any order, and sometimes can be combined in a single or mixed layer. The substrate layer may be formed from a conductive material. In addition, a conductive layer can be formed on a nonconductive substrate.

The charge generating layer is capable of photogenerating charge and injecting the photogenerated charge into the charge transport layer. For example, U.S. Pat. No. 4,855,203 to Miyaka teaches charge generating layers comprising a resin dispersed pigment. Suitable pigments include photoconductive zinc oxide or cadmium sulfide and organic pigments such as phthalocyanine type pigment, a polycyclic quinone type pigment, a perylene pigment, an azo type pigment and a quinacridone type pigment Imaging members with perylene charge generating pigments, particularly benzimidazole perylene, show superior performance with extended life.

In the charge transport layer, the electron donor molecules may be in a polymer binder. In this case, the electron donor molecules provide hole or charge transport properties, while the electrically inactive polymer binder provides mechanical properties. Alternatively, the charge transport layer can be made from a charge transporting polymer such as poly(N-vinylcarbazole), polysilylene or polyether carbonate, wherein the charge transport properties are incorporated into the mechanically strong polymer.

Imaging members may also include a charge blocking layer and/or an adhesive layer between the charge generating and the conductive layer. In addition, imaging members may contain protective overcoatings. Further, imaging members may include layers to provide special functions such as incoherent reflection of laser light, dot patterns and/or pictorial imaging or subbing layers to provide chemical sealing and/or a smooth coating surface.

Although excellent toner images may be obtained with multilayered belt or drum photoreceptors, it has been found that as more advanced, higher speed electrophotographic copiers, duplicators and printers are developed, there is a greater demand on copy quality. A delicate balance in charging image and bias potentials, and characteristics of the toner and/or developer, must be maintained. This places additional constraints on the quality of photoreceptor manufacturing, and thus, on the manufacturing yield. In certain combinations of materials for photoreceptors, or in certain production batches of photoreceptor materials involved in the same kind of materials, localized microdefect sites (which may vary in size from about 50 to about 200 microns) can occur, using photoreceptors fabricated from these materials, where the dark decay is high compared to spatially uniform dark decay present in the sample. These sites appear as print defects (microdefects) in the final imaged copy. In charged area development, where the charged areas are printed as dark areas, the sites print out as white spots. These microdefects are called microwhite spots. Likewise, in discharged area development systems, where the exposed area (discharged area) is printed as dark areas, these sites print out as dark spots in a white background. All of these microdefects, which exhibit inordinately large dark decay, are called charge deficient spots (or CDS).

Since the microdefect sites are fixed in the photoreceptor, the spots are registered from one cycle of belt revolution to the next. Charge deficient spots have been a serious problem for a very long time in many organic photoreceptors. Little progress has been made in developing photoreceptors that resist formation of such charge deficient spots because of a lack of rapid techniques suitable for quickly assessing research laboratory samples. Charge deficient spots are also a source of major yield losses in the production of photoreceptors. The only techniques known in the past for evaluation of the charge deficiency spots in a photoreceptor were through the formation of actual imaging machine prints or the use of a stylus scanner. Both of these techniques have serious flaws. Evaluation through machine testing cannot be accomplished on hand made samples because it is difficult to coat laboratory samples that are large enough to make a belt size sample usable to run in an imaging machine. Also, contributions or "noise" from non-charge deficient spot related defects can overwhelm print quality during testing on imaging machines. Thus, any investigation of the charge deficient spots characteristics on imaging machines is very expensive because belts of a suitable size for testing on such imaging machines must be fabricated on production equipment. The stylus scanner can be used for hand made devices, but it is very slow (e.g. a 1 $cm^2$ area on a sample requires an hour or two to scan). Further, the stylus scanner test can be too sensitive and present serious problems in extrapolating the test results for large area performance (such as full page) from a realistically feasible measurement (e.g. 1 $cm^2$). In response to these problems, an improved method for assessing the occurrence of microdefects is disclosed, for example, in U.S. Pat. No. 5,703,487.

Whether these localized microdefect or charge deficient spot sites will show up as print defects in the final document will depend on the development system utilized and, thus, on the machine design selected. For example, some of the variables governing the final print quality include the surface potential of the photoreceptor, the image potential of the photoreceptor, the photoreceptor to development roller spacing, toner characteristics (such as size, charge and the like), the bias applied to the development rollers, and the like. The image potential depends on the light level selected for exposure. The defect sites are discharged, however, by the dark discharge rather than by the light The copy quality from generation to generation is maintained in a machine by continuously adjusting some of the parameters with cycling. Thus, defect levels could also change with cycling.

Furthermore, cycling of belts made up of identical materials but differing in overall belt size and use in different copiers, duplicators and printers has exhibited different microdefects. Moreover, belts from different production runs have exhibited different microdefects when initially cycled in any given copier, duplicator and printer.

Thus, while microdefects can be detected by various means, as discussed above, it is necessary to register those defects on the photoreceptor such that image quality using the photoreceptor can be increased. However, a need exists in the art for improved ways to register such defects.

Furthermore, a need exists in the art for forming micro-sized markings on photoreceptors, such as for various marking, fiducial, and authenticating reasons. For example, it is desired to place micro-sized markings on photoreceptors to either print such micro-sized images on a resultant print, or to ensure authenticity of the photoreceptor. Where the micro-sized mark is to be printed, such mark could be of a size that appears to the naked eye to be merely a dot, but upon closer magnified examination could be an appropriate desired mark or symbol. However, such marks should preferably not interfere with the operation and print quality of the photoreceptor.

Laser cutting and ablation methods are generally known, and have been applied in various methods in the art. For example, U.S. Pat. No. 4,049,945 describes a method for cutting different shapes in a moving web by using both the motion of the web and the linear scanning of the laser to be able to cut individual features. As a further example, U.S. Pat. No. 4,639,572 describes the cutting of composite materials such as circuit boards that contain a filler and a polymer matrix. U.S. Pat. No. 5,630,308 describes a method for the scoring of packaging material using a laser such that the scored line is weakened to enable controlled tearing of the material. U.S. Pat. No. 4,549,063 describes using a laser to make discontinuous cuts to provide perforations in an adhesive laminate. The perforations permit tearing labels off of a laminate backing. Laser cutting methods are also known in the art for forming large parts. For example, laser patterning and cutting methods have been used in many areas, such as sheet metal fabrication, cloth cutting, and paper cutting.

Laser ablation has been used to form specific features in particular products, such as for forming features in ink jet die modules, such as ink passageways, orifices, and the like. U.S. Pat. No. 5,208,604 describes an ink jet head wherein the ink discharge opening is formed by laser ablation, i.e., by irradiating an excimer laser onto the discharge opening plate. Similarly, U.S. Pat. No. 5,312,517 and U.S. Pat. No. 5,442,384 disclose forming specific features in an ink jet head using laser ablation methods.

U.S. Pat. No. 5,643,706 discloses a method for forming an electroconductive member such as an imaging member, an intermediate belt, and an electroded donor or bias transfer roll for electrostatographic development. The method includes the steps of forming a roll having a layer of an insulating material, and altering an electrical property of the insulating material by irradiating the insulating material with a laser beam. The method can be used, for example, to alter the conductivity of portions of the insulating material such that the irradiated portions form a pattern of electrically conductive pathways in the insulating layer.

U.S. Pat. No. 5,688,355 also discloses the use of excimer lasers, for laser ablation, in forming photoreceptors. The patent discloses a process whereby a seamed flexible belt photoreceptor is made by laser ablating portions of the belt, and then fusing those portions together to form an endless belt.

In a similar manner, U.S. Pat. No. 5,320,789 discloses a composition that is suitable to be irradiated by a laser source. Irradiation with a laser is disclosed to alter the surface adhesive properties of the material, such that subsequent layers can be bonded to the material.

Laser ablation or laser marking is also known as a means for marking or printing on power cables, wires and the like. For example, U.S. Pat. Nos. 5,415,939 and 5,091,284 disclose various polymer materials, which can be used to form an electrical cable. A portion of the material can be irradiated to provide visible data markings on the cable.

SUMMARY OF THE INVENTION

There is a need in the art for improved methods for permanently marking photoreceptors, for various purposes. For example, there is a need for a precision method to permanently mark photoreceptors to register charge deficient spots so that the spots can be passed over during the imaging process, thereby avoiding the introduction of image defects on resultant prints. Furthermore, for example, there is a need for a precision method to permanently mark photoreceptors to provide fiducial marks, which can either appear or not appear on a resultant printed image, for example to authenticate the printed images or to authenticate the photoreceptor itself.

The present invention addresses these need, and others, by providing a permanent marking system, using laser ablation, to permanently mark photoreceptors. The present invention provides a process that allows for high precision in marking, and resultant high detail in the marking. Thus, for example, the present invention can be used to register charge deficient spots, can be used to provide permanent marking on the photoreceptor to print information on resultant prints, and can be used to permanently mark the photoreceptor to authenticate the photoreceptor.

The present invention is directed to a method of forming fiducial or registration marks on a photoreceptor. In particular, the present invention is directed to a method for permanently marking a photorecetor surface, comprising the steps of:

- irradiating a surface of a photoreceptor with an irradiation source to permanently mark said photoreceptor, and
- ablating material from said photoreceptor to at least one controlled depth in said photoreceptor with said irradiation source.

In embodiments, the marking method can be used to register the locations of charge deficient spots on the photoreceptor, can be used to label (data) mark the photoreceptor, or can be used to authenticate the photoreceptor and/or images made using the photoreceptor.

DETAILED DESCRIPTION OF PREFERRED EMBODIMENTS

The present invention relates a laser ablation method for forming fiducial or registration marks on a photoreceptor.

According to the present invention, such marks can be formed on any of the currently known or after-developed imaging members, including organic imaging members, inorganic imaging members, and the like. Such various imaging member designs are well-known in the art and thus need not be described in detail herein. Such imaging members preferably include at least a charge generating layer and a charge transport layer, which may be separate layers are combined together in a single layer, and may include any of an anti-curl layer, a substrate, a conductive layer, a ground plane, a blocking layer, an adhesive layer, an underlayer, an overcoating layer, and the like. However, for the purposes of illustration only, such imaging members are described, for example, in U.S. Pat. Nos. 5,891,594, 5,874,193, 5,709,974, 5,703,487, 5,614,341, 5,576,130, 5,521,047, 4,871,634 and 4,588,666, the entire disclosures of which are incorporated herein by reference.

According to the present invention, the photoreceptor surface is selectively precision marked using a laser source. The precision marking forms preferably permanent markings on the photoreceptor, by ablating (or removing) material from the photoreceptor at the desired location. Preferably, the laser ablation of the photoreceptor forms a "hole" in the photoreceptor, at least to a sufficient depth into the photoreceptor to achieve the desired goal. Thus, for example, the laser ablation can form a hole only through a surface layer (or only a portion thereof) of the photoreceptor, leaving the underlayers intact, or can form a hole through multiple layers of the photoreceptor. Preferably, the laser ablation does not form a hole through the entire photoreceptor structure, i.e., through every layer including a substrate and/or backing layer; however, such through holes may be made, if desired.

The method of precision marking the photoreceptor will now be described in detail. In contrast to the prior art, which generally used laser ablation to cut parts from a bulk material, or to affect surface properties of a bulk material, the present invention uses a laser cutting process to precisely and permanently mark a photoreceptor. The laser ablation process of the present invention provides advantages over prior art marking methods, in terms of allowing more precise marking and reduced feature size (i.e., micro-sized markings not visible to the naked eye).

In embodiments of the present invention, any suitable laser (irradiation) source may be used as the marking tool. Suitable laser sources include, but are not limited to, solid state lasers such as Nd:YAG (neodymium:yttrium aluminum gamet) lasers and their harmonics at shorter wavelength, ultraviolet lasers such as excimer lasers, free electron lasers, gas discharge lasers such as argon ion or krypton ion lasers or copper vapor lasers, infrared lasers such as Rf (radio-frequency discharge) $CO_2$ lasers or TEA (transverse electric discharge-atmospheric pressure) $CO_2$ lasers, and the like. In some embodiments, the material used to form various layers of the photoreceptor may absorb the laser emission. Therefore, ultraviolet lasers such as the excimer laser and the $3^{rd}$ harmonic of the Nd:YAG laser are preferred over the fundamental wavelength of the Nd:YAG laser or lasers emitting in the visible light area of the spectrum. Also, the 9.4 $\mu$m wavelength $CO_2$ laser is preferred over the 10.6 $\mu$m $CO_2$ laser because of the higher absorption of most polymeric materials at 9.4 $\mu$m. Such higher absorption generally provides for faster ablation of the material.

Specific selection of a laser source will depend on the composition and physical properties of the photoreceptor material being processed, the thickness of each of the several layers in the photoreceptor, the overall thickness of the photoreceptor, the desired depth of ablation into the photoreceptor structure, spatial resolution required, the desired surface quality, and economic considerations such as power consumption, equipment cost, maintenance cost, and processing speed. For example, a Rf $CO_2$ laser may be preferred in some embodiments, because it offers low cost for the laser and its operation and it delivers higher levels of power to the material, enabling rapid processing. However, the design rules for the Rf $CO_2$ laser are limited by the presence of a heat-affected zone of about 10 $\mu$m–50 $\mu$m in width at the edges of the irradiated location, and by a relatively large focused spot diameter of typically >50 $\mu$m. In other embodiments, an excimer laser may be preferred because it offers a much finer resolution, of about 2 $\mu$m–5 $\mu$m, and a heat-affected zone of less than about 5 $\mu$m in width at the edges of the irradiated location, although at higher costs. In still other embodiments, a TEA $CO_2$ laser may be preferred as a compromise between cost, feature size and edge quality.

To perform the laser ablation process of the present invention, the energy characteristics of the laser source are preferably adjusted so as to provide the desired penetration depth and marking properties. For example, in an exemplary embodiment where a KrF excimer laser operating at 248 nm is used as the laser source, the laser can effectively and precisely ablate material at an energy density of 0.3 $J/m^2$ to 4 $J/cm^2$. In the case of a $RF/CO_2$ laser source, an laser power of from about 10 to about 500 W, preferably from about 25 to about 300 W, and even more preferably from about 25 to about 150 W, may be used with a spot diameter at the substrate between 50 and 250 $\mu$m and more preferably between 60 and 130 $\mu$m. However, the light intensity will of course depend upon the specific laser source being used and the specific photoreceptor material being cut, and so values outside of these ranges may be used, as necessary.

Furthermore, it will be readily recognized that the laser processing parameters may be adjusted within broad ranges to account for the specific properties desired, the materials being used, the laser power, and ablation precision. For example, the specific laser process parameters, such as fluence, intensity, and spot diameter may depend upon such factors as wavelength and type of the laser, rate of irradiation, pulse width, energy level, and the like. Based on this disclosure one skilled in the art can select such processing parameters for a specific photoreceptor material to be processed.

According to the present invention, the laser ablation process can form marks having an average diameter of from about 1 $\mu$m, to as large as desired. Thus, for example, where it is desired that the marks be visible, for example to the human eye, such marks can be as large as desired. However, where it is desired that the mark not be visible to the human eye, the resolution is preferably much smaller. In embodiments, the process of the present invention forms marks having an average diameter of from about 1 $\mu$m to about 200 $\mu$m, preferably from about 2 $\mu$m to about 100 $\mu$m, and more preferably from about 5 $\mu$m to about 50 $\mu$m. In other embodiments, the marks can be equal to or smaller than the size of a typical pixel of a photoreceptor, i.e., about 40 $\mu$m.

A benefit of the present invention is that it permits for precise placement and detail of marks on photoreceptors. Laser ablated marks made according to the present invention can be used to replace commonly used marking processes in the art, such as opaque paints or conductive paints tied to the ground plane of the photoreceptor. Whereas these commonly used processes pose problems, such as in terms of resolution, non-permanency, and the like, the laser ablation process provides permanent marks that can be formed to any desired depth into the photoreceptor, while providing extremely high resolution, precision and detail.

For example, the laser marking process may be used to provide registration of charge deficient spots on the photoreceptor. In this embodiment, the present invention can be used to mark the photoreceptor to identify and locate such defects. A high precision optical system could then utilize such markings to register the size, location and distribution of photoreceptor defects.

Other laser marking patterns could also be used for other purposes. For example, precisely detailed marks could be made onto the photoreceptor as a means to authenticate the photoreceptor itself. That is, the mark could be used to identify the manufacturer of the photoreceptor, or any other desired information.

Likewise, the markings can be made into the photoreceptor as a means to print precisely detailed images on resultant prints. For example, in the case of dark area development, the laser ablated spots would remain uncharged during the development process, and would thus print in the resultant images as dark spots. Precise detailing of the marks would permit printing of marks on the resultant images (prints), either clearly visible or not, which can be used to authenticate the prints themselves.

According to the present invention, the marks made on the photoreceptor can range anywhere from for example, a single dot, to particular symbols to data markings of, for example, letters, numbers, and/or words. For example, registration marks for charge deficient spots may be made as either a dot or a line; fiducial marks may be made as a dot, a symbol, or as data; and other marks can be made as, for example, a background image, words, or the like.

While the invention has been described in conjunction with the specific embodiments described above, it is evident that many alternatives, modifications and variations are apparent to those skilled in the art. Accordingly, the preferred embodiments of the invention as set forth above are intended to be illustrative and not limiting. Various changes can be made without departing from the spirit and scope of the invention.

What is claimed is:

1. A method for permanently marking a photoreceptor surface, comprising the steps of:

irradiating a surface of a photoreceptor with an irradiation source to permanently mark said photoreceptor, and ablating material from said photoreceptor to at least one controlled depth in said photoreceptor with said irradiation source.

2. The method of claim 1, wherein said photoreceptor comprises a charge generating layer comprising an organic charge generating material.

3. The method of claim 1, wherein said photoreceptor comprises a charge generating layer comprising an inorganic charge generating material.

4. The method of claim 1, wherein said mark is a registration mark for locating charge deficient spots on said photoreceptor.

5. The method of claim 1, wherein said mark is a data mark positioned in a non-imaging area of said photoreceptor.

6. The method of claim 1, wherein said mark is a data mark positioned in an imaging area of said photoreceptor.

7. The method of claim 6, wherein said data mark creates an image during development that is visible only under magnification.

8. The method of claim 6, wherein said data mark creates an image during development that is visible without magnification.

9. The method of claim 1, wherein said mark is a fiducial mark for authenticating the photoreceptor or for authenticating prints produced therefrom.

10. The method of claim 1, wherein said irradiation source is a laser.

11. The method of claim 10, wherein said laser is selected from the group consisting of a solid state laser, an infrared laser, a free electron laser, a gas discharge laser, a visible light laser, and an ultraviolet laser.

12. The method of claim 11, wherein said laser is an ultraviolet laser selected from the group consisting of an excimer laser and the third or fourth harmonic of a solid state laser.

13. The method of claim 12, wherein said laser is an excimer laser selected from the group consisting of a KrF laser, a XeF laser, a XeCl, and an ArF laser.

14. The method of claim 11, wherein said laser is a Rf $CO_2$ laser or a TEA $CO_2$ laser.

15. The method of claim 1, wherein said at least one controlled depth is an entire depth of a surface layer of said photoreceptor.

16. The method of claim 1, wherein said at least one controlled depth is an entire depth said photoreceptor exclusive of a substrate layer.

17. The method of claim 1, wherein said mark has a diameter of less than 40 $\mu$m.

18. A method for registering charge deficient spots on a photoreceptor surface, comprising the steps of:

locating a charge deficient spot on a photoreceptor;

irradiating a surface of said photoreceptor with an irradiation source to permanently mark said photoreceptor, and ablating material from said photoreceptor to at least one controlled depth in said photoreceptor with said irradiation source, wherein said mark registers the location of the charge deficient spot.

* * * * *